US007032655B2

(12) United States Patent
Wanni et al.

(10) Patent No.: US 7,032,655 B2
(45) Date of Patent: Apr. 25, 2006

(54) ANTI-VIBRATION TUBE SUPPORT

(75) Inventors: Amar S. Wanni, Falls Church, VA (US); Roberto C. Tomotaki, Humble, TX (US); Thomas M. Rudy, Warrenton, VA (US); Marciano M. Calanog, Stafford, TX (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 0 days.

(21) Appl. No.: 10/848,903

(22) Filed: May 19, 2004

(65) Prior Publication Data

US 2005/0006075 A1 Jan. 13, 2005

Related U.S. Application Data

(60) Provisional application No. 60/480,921, filed on Jun. 24, 2003, provisional application No. 60/511,623, filed on Oct. 15, 2003.

(51) Int. Cl.
*F28D 7/00* (2006.01)

(52) U.S. Cl. ..... 165/162; 248/68.1; 165/165; 165/172

(58) Field of Classification Search ..... 165/165, 165/172, 162; 248/68.1; 138/106, 107, 138/112, 115–117
See application file for complete search history.

(56) References Cited

U.S. PATENT DOCUMENTS

| | | | | | |
|---|---|---|---|---|---|
| 3,933,583 | A | * | 1/1976 | Jabsen | 376/438 |
| 4,160,477 | A | * | 7/1979 | Roffler | 165/172 |
| 4,175,003 | A | * | 11/1979 | Beuchel et al. | 376/442 |
| 4,359,088 | A | * | 11/1982 | Jabsen | 165/172 |
| 4,570,703 | A | * | 2/1986 | Ringsmuth et al. | 165/162 |
| 4,648,442 | A | | 3/1987 | Williams | 165/172 |
| 4,781,884 | A | * | 11/1988 | Anthony | 376/352 |
| 4,860,697 | A | * | 8/1989 | Malaval | 165/162 |
| 4,919,199 | A | | 4/1990 | Hahn | 165/165 |
| 5,072,786 | A | * | 12/1991 | Wachter | 165/162 |
| 5,213,155 | A | | 5/1993 | Hahn | 165/122 |
| 6,401,803 | B1 | | 6/2002 | Hahn | 165/165 |

* cited by examiner

*Primary Examiner*—Teresa J. Walberg
(74) *Attorney, Agent, or Firm*—Glenn T. Barrett

(57) ABSTRACT

A tube support device comprises an elongated strip inserted in a tube lane between the tubes of the tube bundle. Raised-tube-engaging zones are disposed in transverse rows across the strip at successive longitudinal locations along its length; these tube-engaging zones extend laterally outwards from both faces of the strip to engage with tubes on opposite sides of the tube lane. The tube-engaging zones may be arranged so that they extend from the two faces of the strip in an alternate manner, with the tube-engaging zones in each row alternately extending from one face and then from the other along the row.

23 Claims, 7 Drawing Sheets

ANTI-VIBRATION TUBE SUPPORT

CROSS REFERENCE TO RELATED APPLICATIONS

This application claims priority from application Ser. No. 60/480,921, filed 24 Jun. 2003, entitled "Anti-Vibration Tube Supports" of M. M. Calanog, T. M. Rudy, R. C. Tomotaki and A. S. Wanni and from application Ser. No. 60/511,623, filed 15 Oct. 2003, entitled "Anti-Vibration Tube Support" of T. M. Rudy and A. S. Wanni, the disclosures of which are incorporated by reference.

FIELD OF THE INVENTION

This invention relates to tube supports devices, commonly referred to as tube stakes which are useful with tube bundles in heat exchangers and similar fluid-handling equipment.

BACKGROUND OF THE INVENTION

Tube bundle equipment such as shell and tube heat exchangers and similar items of fluid handling devices utilize tubes organized in bundles to conduct the fluids through the equipment. In such tube bundles, there is typically fluid flow both through the insides of the tubes and across the outsides of the tubes. The configuration of the tubes in the bundle is set by the tubesheets into which the tubes are set. One common configuration for the tubes is the rectangular formation with the tubes set in aligned rows with tube lanes (the straight paths between the tubes) between each pair or rows, aligned orthogonally to one another. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent six other tubes (the two adjacent tubes in the same row and four tubes in the two adjacent rows).

Fluid flow patterns around the tubes as well as the changes in the temperature and density of the fluids which arise as they circulate a result of the heat exchange between the two fluids flowing in and around the tubes may give rise to flow-induced vibrations of an oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without heat transfer taking place.

Besides good equipment design, other measures may be taken to reduce tube vibration. Tube support devices or tube stakes as these support devices are commonly known (and referred to in this specification) may be installed in the tube bundle in order to control flow-induced vibration and to prevent excessive movement of the tubes. A number of tube supports or tube stakes have been proposed and are commercially available. One type, described in U.S. Pat. No. 4,648,442 (Williams) has a U-shaped configuration in which the distance between the top and bottom surfaces of the channel is the same as the distance between adjacent rows in the tube bundle (i.e. is substantially the same as the tube lane dimension). This type of stake is inserted between the rows in the bundle and is secured at end by an arcuate segment which engages a segment of a tube at the periphery of the tube bundle so as to lock the stake in place in its appropriate position between the rows in the bundle. Stakes of this type are typically made of a corrosion-resistant metal, for example, type 304 stainless steel with a thickness between 0.7 and 1.2 mm to provide both the necessary rigidity for the staked tube bundle as well as sufficient resilience in the U-shaped channel to allow the stakes to be inserted into the lanes between the tubes in the bundle.

Another form of anti-vibration tube stake is described in U.S. Pat. No. 4,919,199 (Hahn) which discloses a stake made in a soft V-configuration strip in which saddles are formed perpendicular to the longitudinal axis of the strip in the open ends of these V-shaped cross sections. The saddles are formed in the strip with a pitch (distance between saddles) equal to the tube pitch and with a radius which matches that of the tubes in the tube bundle so the saddles engage with the tubes on one side of the tube lane. The engagement between these tubes and the saddles locks the tube into place in the tube bundle. The resilient nature of the strip, coupled with the spring type action provided by the V-configuration permits the arms of the V to open and reduce the effective overall width of the stake enables the stake to engage the tubes on both sides of a tube lane in so that the V-shaped stake is locked into place between the two rows of tubes.

A similar type of tube stake is described in U.S. Pat. No. 5,213,155 (Hahn) which discloses a U-shaped stake which is inserted between two tube lanes with the closed end of the U over one of the peripheral tubes in the bundle. Saddles are formed in the open ends of the V-shaped cross section to engage with opposite sides of the tubes in a single row in the bundle. The U-shaped stake is fastened in place around the tubes of the bundle by suitable fasteners extending between the two arms of the stake.

One problem with the pressed configuration of the type shown in U.S. Pat. No. 4,648,442 is that the stakes do not create a positive location for each individual tube, although the stake is locked into place in its selected tube lane. The tubes remain free to vibrate in one plane parallel to the tube lane and parallel to the stake. A different problem exists with the design shown in U.S. Pat No. 5,213,155: although the tubes in rows encircled by the U-shaped stakes are fully supported, the tubes at the periphery of the tube bundle which are not directly encircled by one of the stakes i.e., retained within one of the closed ends of the U-shaped stakes (these are the outer tubes in alternate rows which are not encircled by the ends of the U-shaped stakes), are free to move and vibration in these tubes can be expected under certain conditions. In addition, because the corrugation of the tube support has a transition region before reaching its full depth the two tubes adjacent to each of the outermost tubes do not receive any vibration mitigation either.

One disadvantage of the stake designs which use channel pressings to accommodate the distance between the tubes forming a single tube lane is that deep channel pressings are required or other measures necessary when the tube lane is relatively wide. A more complicated form of tube support is shown in U.S. Pat. No. 6,401,803 (Hahn). This stake uses two V-shaped pressings separated by compression springs which force the stakes against the tubes on opposite sides of the tube lane in order to dampen oscillatory vibrations. This form of stake is, however, quite expensive to manufacture. A unitary stake which will accommodate relatively wide tube lanes without the complication of separate parts therefore remains desirable.

SUMMARY OF THE INVENTION

According to the present inventions, a tube support device or tube stake which is useful to mitigate the possibility of tube damage from flow-induced vibration in tube bundles comprises an elongated member or strip which is intended to be inserted in a tube lane between the tubes of a tube bundle in a heat exchanger, condenser or other tube bundle device. Raised-tube-engaging zones are disposed in transverse rows across the strip at successive longitudinal locations along the length of the strip; these tube-engaging zones extend laterally from both faces of the strip, away from the medial plane of the strip, to engage with tubes on opposite sides of the tube lane into which the stake is inserted. The tube-engaging zones are preferably arranged so that they extend laterally from the two opposed faces of the strip in an alternating manner, with the tube-engaging zones in each row alternately extending first from one face of the strip and then the other, along the row. This alternating arrangement within each transverse row is preferably used with a second alternating arrangement in which the raised tube-engaging zones alternate from one face of the strip to the other at the same transverse location in successive rows. The raised, tube-engaging zones may suitably be formed as dimples or corrugations which extend longitudinally along the strip to engage the successive pairs of tubes which are opposite one another on a tube lane and located adjacent to one another in a tube row. In one form, the tube-engaging zones are in the form of corrugations on the inner portion of the tube stake and dimples at the outer portion; this hybrid configuration allows ready insertion of the tube stake into the tube bundle but provides good locking once the stake is emplaced.

The tube stakes may be used in both conventional tube formations, either the rectangular formation or the triangular tube formation. The stakes may be inserted into each tube lane or into alternate tube lanes. When inserted into each tube lane, the tubes receive support from stakes on both sides. Because the effective gap between the tubes (tube lane dimension) is smaller with the triangular formation the thickness as well as the height of the raised tube-engaging zones will normally be smaller in order for the stake to be inserted between the tube lanes with this configuration.

The tube stakes of the present invention may be conveniently and inexpensively fabricated by pressing with dies equipped with suitably arranged protrusions and cavities to form the dimples, corrugations or other forms of tube-engaging zones or by the use of pairs of rollers which have protrusions and cavities (alternating between the top and bottom rollers of the set) to form the raised zones on the strip. Many of the known types of tube stake do not lend themselves to this economical and convenient method of fabrication.

DRAWINGS

FIG. 1 is a cross-section of four tubes in a rectangular arrangement heat exchanger with a tube stake according to the present invention supporting the tubes.

FIG. 1A. is a section along line X—X of FIG. 1.

FIG. 1B. is a section along line Y—Y of FIG. 1.

FIG. 2 shows a tube stake with alternating raised tube-engaging zones on each side of the stake for supporting the tubes in a heat exchanger with a triangular tube configuration.

FIG. 2A. is a section along section line X—X of FIG. 2.

FIG. 2B. is a section along section line Y—Y of FIG. 2.

FIG. 3 is a cross-section of four tubes in the tube bundle of a rectangular arrangement configuration with a tube stake having alternating longitudinal corrugations on each side of the stake.

FIG. 3A. is a section along line X—X of FIG. 3.

FIG. 3B. is a section along line Y—Y of FIG. 3.

DETAILED DESCRIPTION

The tube support device or tube stake of the present invention is arranged to provide direct support for tubes which are adjacent to one another but on opposite sides of a tube lane. The tube stake may be inserted between the tubes in the tube bundle along a tube lane between adjacent tube rows. Where the construction of the exchanger permits, the stake may be made sufficiently long to extend from one side of the tube bundle to the other to provide support for the tubes across the entire width of the bundle; in this case, the length of the tube stakes will vary according to the length of the tube lanes across the bundle. In many cases, however, the location of pass lanes in the bundle will create discontinuities in the lanes so that it will not be possible to insert the stakes all the way across the bundle. In such cases, it may be possible to insert the stakes into the bundle from different angles along the length of the bundle in order to provide as much support as possible for the tubes. Thus, the stakes will be inserted transversely into the bundle at each axial location in an angularly variant direction (at a different angle in the transverse plane of the tubes) from the direction of insertion at the next axially adjacent location. This may, however, leave the tubes without staked support in some parts of the bundle, normally in the middle of the bundle where access from the periphery is precluded. In view of their simple and repetitive configuration, the present tube stakes may be readily cut to the desired length to fit the bundle, whether extending entirely across it or only part of the way.

Figure 1:
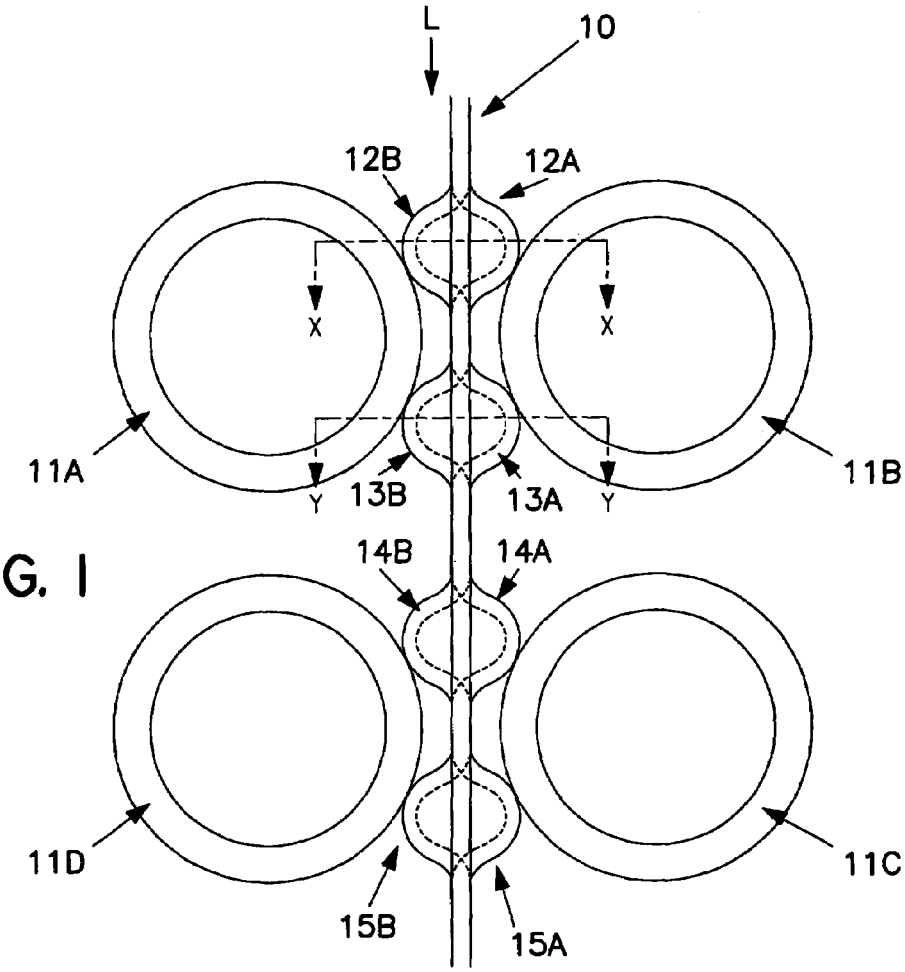

FIG. 1 shows four adjacent tubes in a tube bundle with a rectangular tube formation. A tube support device or tube stake according to the present invention is inserted into the tube lane between two rows of tubes. Tube stake 10 formed from a strip of metal extends in tube lane L defined by tubes 11A and 11D on one side of the lane and tubes 11B and 11C on the other side of the tube lane. Of course, in the complete tube bundle, there will be additional tubes extending in the row formed by a continuation of the tube row containing tubes 11A, 11D and another row continuing on from tubes 11B and 11C, with other tube rows arranged in similar conventional manner making up the tube bundle. The tube lanes between these two adjacent rows and other adjacent rows of tubes will be similarly extensive across the tube bundle. Tube stake 10 is of the dimpled type which has the tube-engaging zones in the form of raised dimples arranged in transverse rows 12, 13, 14, 15 of three dimples across the strip. The transverse rows are arranged at successive longitudinal locations along the length (longitudinal axis) of the strip rows: each pair of successive rows is positioned to provide support for a pair of tubes which are adjacent one another and on opposite sides of the tube lane. Thus, the dimples in rows 12 and 13 provide support for tubes 11A and 11B, the dimples in rows 14 and 15 provide support for the tubes in rows 11D and 11C. In a similar manner, successive opposite pairs of tubes along the same tube lane are supported by successive pairs of transverse rows of dimples.

Figure 1A:
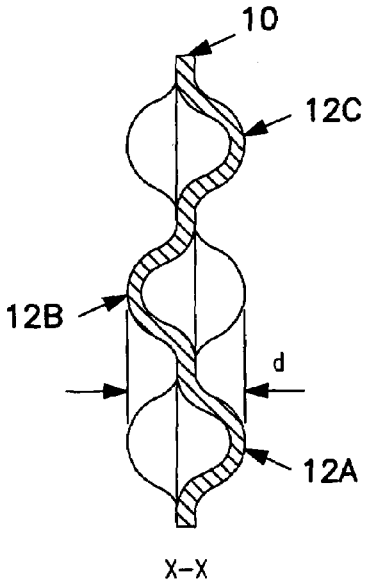
Figure 1B:
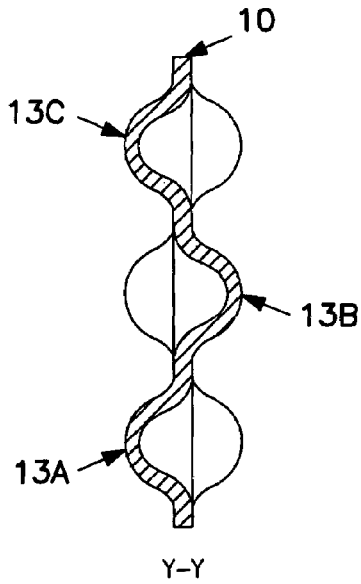
Figure 4:
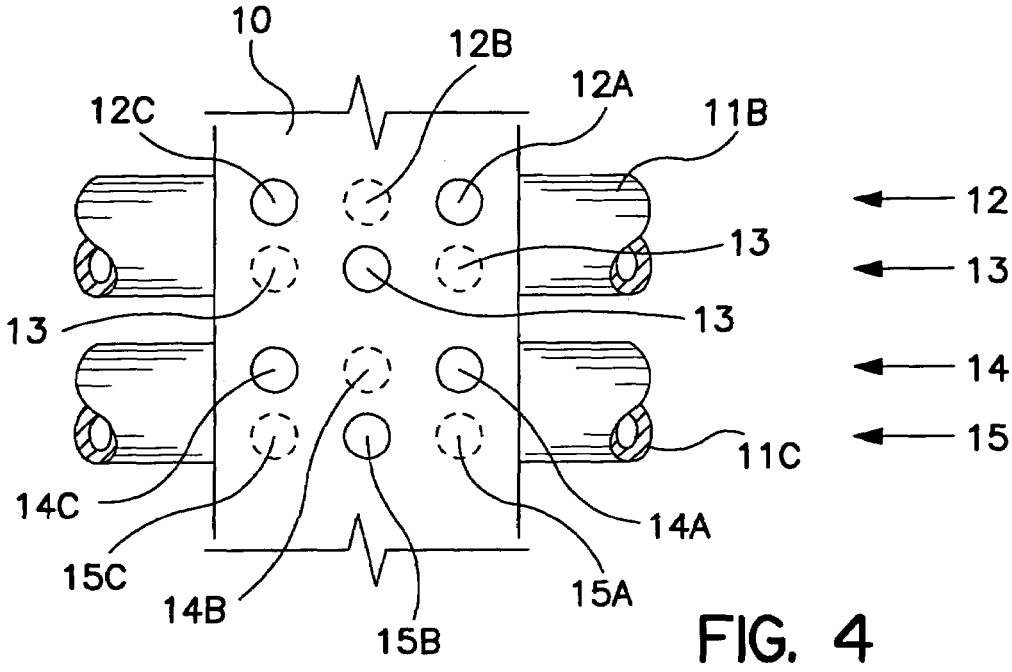
FIG. 4 is a view of the tube stake of FIG. 1 showing the alternating arrangement of raised tube-engaging zones.
Figure 5:
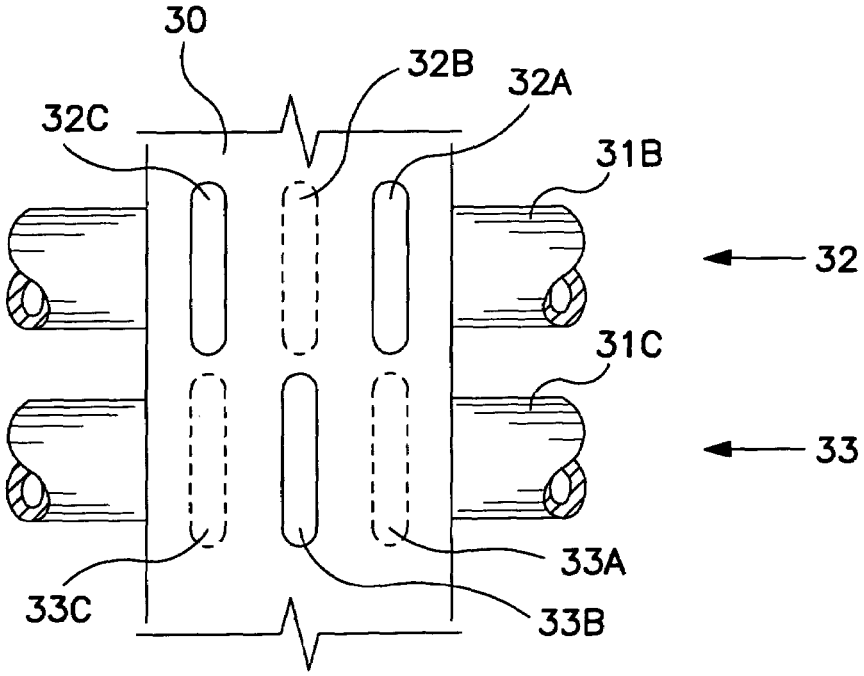
FIG. 5 is a view of the tube stake of FIG. 4 showing the alternating arrangement of tube-engaging zones.

The dimples in row 12 are formed as shown in FIGS. 1A and 4 with two dimples extending laterally out from one face of the strip to form raised tube-engaging zones 12A and 12C on one side of metal strip which extend in the direction towards tube 11B and a single dimple 12B on the other side of the strip extending in the direction towards tube 11A. In FIG. 4, dimples which extend laterally from the strip towards tube 11B are designated by complete circles, the dimples which extend towards tube 11A are shown by dashed circles; this convention is used also in FIG. 5 to indicate zones extending in the two lateral directions from the faces of the strip. The raised tube-engaging zones in the next successive transverse row 13 making up the pair of rows supporting tubes 11A and 11B, are similar but with the raised dimples arranged in alternate fashion to that of line 12, as shown in FIGS. 1B and 4. In this row, dimples 13A and 13C extend in the direction towards tube 11A and single dimple 13B extends out towards tube 11B. Thus, the two rows 12 and 13 of dimples provide support for tubes 11A and 11B on opposite sides of tube lane L. Similarly, with tubes 11C and 11D, transverse row 14 of raised tube-engaging zones is formed as dimples 14A, 14B and 14C which are arranged in the same manner as transverse row 12 and the arrangement of dimples in transverse row 15 matches that of row 13: the raised tube-engaging zones in row 14 in the form of dimples 14A and 14B which extend laterally out from one face of strip 10 towards tube 11C and single dimple 14B extends out towards tube 11D; in row 15, dimple 15B extends laterally out from one face of strip 10 towards tube 11C and dimples 15A and 15B extend out towards tube 11D. These raised tube-engaging zones therefore engage tubes 11C and 11D to provide support for these two adjacent tubes on opposite sides of the tube lane.

The arrangement shown in FIGS. 1, 1A and 1B with three raised tube-engaging zones in each transverse row is convenient and typical for a tube stake with a width of approximately 4–6 cm, convenient for many applications. However, the width of the stake could be larger, for example, up to about 20 cm and in this case a larger number of raised tube-engaging areas could be provided in each transverse row, for example, 5 raised dimples arranged 3 and 2 on alternate sides of the strip. It is not essential to use an odd number of raised zones although this provides a symmetrical degree of support with three, the minimum number of tube-engaging zones. Other arrangements might, however, be used, depending on the number of raised, tube-engaging zones in each transverse row. For example, using a convention to designate rows 12 and 13 as:

| | |
|---|---|
| Row 12: | UP - DOWN - UP |
| Row 13: | DOWN - UP - DOWN, |

a pair of rows in a wider strip with four raised tube-engaging zones might suitably have the following arrangement:

| | |
|---|---|
| Row 1: | UP - DOWN - UP - DOWN |
| Row 2: | DOWN - UP - DOWN - UP |

The use of the larger number of tube-engaging zones on this wider strip permits, however, a deviation from the alternating arrangement of tube-engaging zones while still retaining a symmetrical disposition, for example:

| | |
|---|---|
| Row 1: | UP - DOWN - DOWN - UP |
| Row 2: | DOWN - UP - UP - DOWN |

Note: the designations "UP" and "DOWN" do not refer to true vertical directions but only to the relative directions from the medial plane and faces of the strip.

The number of dimples may be varied according to the width of the strip and the depth (or height) of the dimples The total depth (d) of the dimples (peak to valley, including plate thickness) will naturally be related to the separation between the tubes which are to be engaged byte tube-engaging zones of the strip, i.e. to the dimension of the tube lane. It will also vary according to the diameter of the tubes because this will affect the level (relative to the tube) at which engagement will occur when the stake is in place in the tube bundle. Typically, the total depth of the tube-engaging zones, 4 will be from 0.5 to 2 mm, preferably 0.5 to 1.5 mm greater than the spacing between the tubes at the point where tube engagement occurs so that a tube deflection of similar magnitude is achieved at this point. The exact deflection achieved in practice will be less than the total depth of the stake because the dimples fit around the tube but this stake depth will normally be found suitable to give a tube deflection which provides good support and vibration resistance and results in a very rigid tube bundle. The elasticity of the stake itself and the elasticity of the tubes, coupled with engagement between the raised tube-engaging zones and the tubes will not only make the tubes more resistant to vibration but also retain the stake in place in the bundle. Desirably, the total depth of the tube-engaging zones (the tip-to-valley distance including strip thickness, b, is selected so that each stake deflects the tube from its rest position with a minor tube deflection, typically about 0.5 to 2 mm. This is a feature of the present type of stake which permits the use of a smaller number of stakes than has been customary, typically, about 50% fewer than would otherwise be needed. One advantage of the present type of tube stake is that relatively wide tube lanes can be accommodated without deep pressing of the strips since about half the tube lane dimension is taken up by each raised zone.

In addition to the total depth of the stake, the thickness and stiffness of the metal of the strip will be factors in fixing the final tube deflection when the stakes are inserted into the bundle. Normally, with the metals of choice, a strip thickness of from 1 to 2 mm will be satisfactory to provide adequate tube support and ability to resist the stresses of insertion into the bundle.

The raised, tube-engaging zones are not necessarily in the form of circular dimples. As shown in FIGS. 3, 3A, 3B, 3C below, they may be longitudinally extensive corrugations or, as in FIGS. 6 and 7, combinations of dimples and corrugations. Other configurations are, however, possible as long as the essential functional objective of engaging with the tubes is retained. Tube-engaging zones in the form of circular dimples are easy to fabricate but dimples of other shapes may also be used, for example, dimples with a triangular, rectangular, square or other polygonal form or with an elliptical or an oval (race-course) shape. The tube-engaging zones could also be in the form of transversely-extensive corrugations on a strip of suitable width to accommodate the corrugations. This form of tube stake would be advantageous in that the increased width, coupled with the increased engagement between the tubes and the transverse corrugations, would give greater support to the tubes; although more expensive individually, fewer rows of stakes may be required while still retaining adequate support for the tube bundle.

Figure 2:
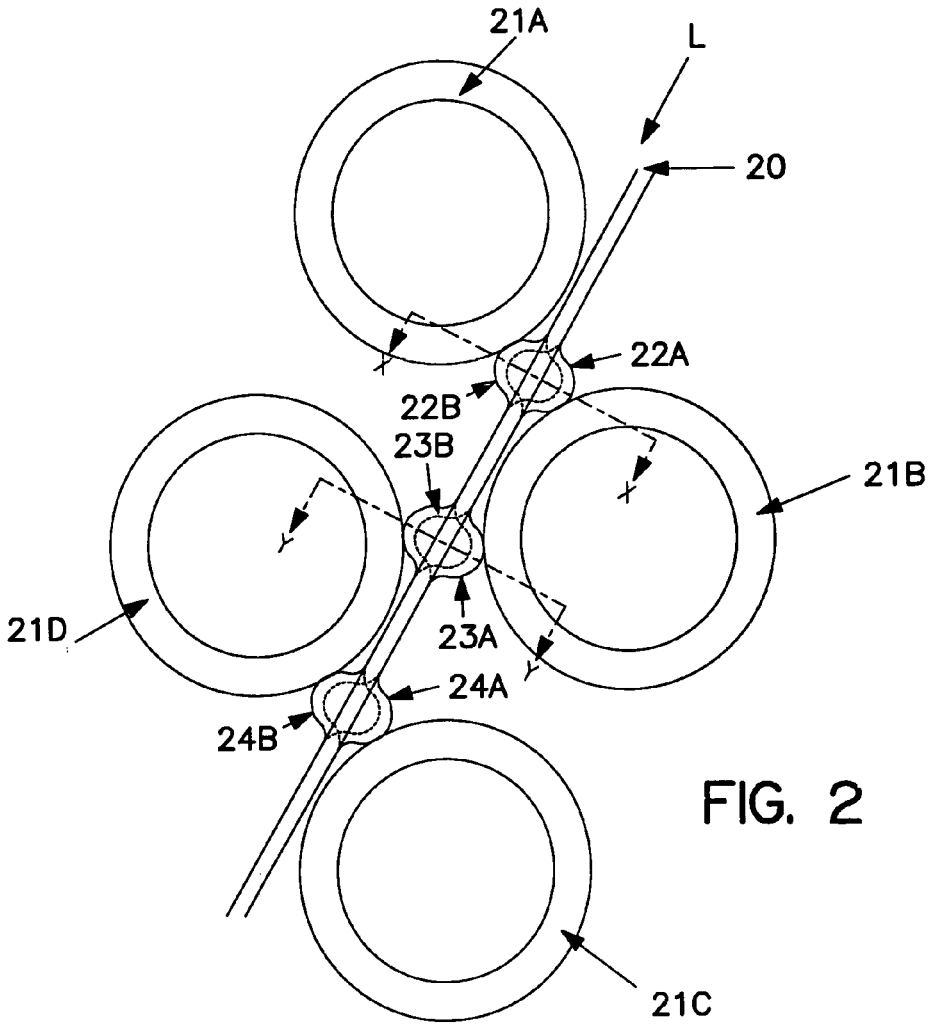
Figure 2A:
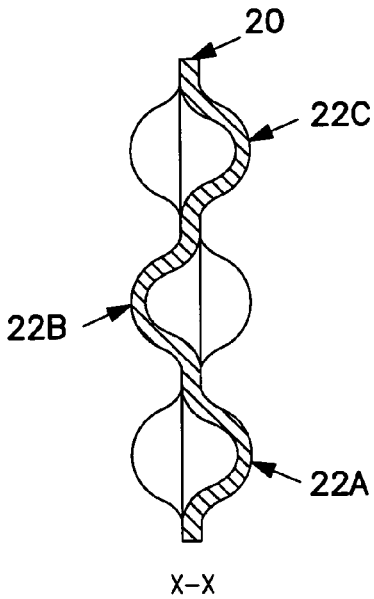
Figure 2B:
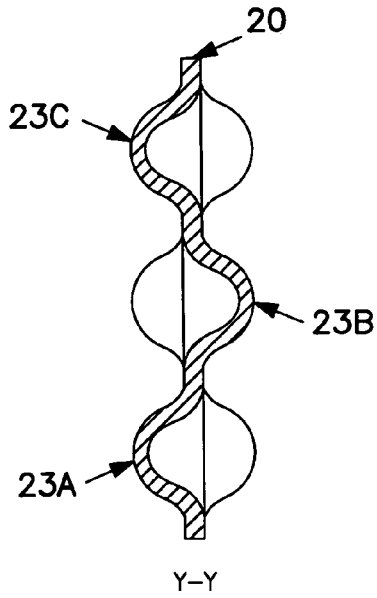

FIG. 1 shows the tube stake in place in a rectangular tube formation. Stakes may also be employed with triangular tube formations, as shown in FIG. 2. In FIG. 2, tube stake 20 runs in the tube lane between tubes 21A and 21D on one side of tube lane L, and tubes 21C and 21D on the other side of the tube lane. A first transverse row 22 of raised, tube-engaging zones is provided by dimples 22A and 22C extending out from one face of the strip to engage tube 21B and by a single dimple 22C on the opposite face of the strip engaging tube 21A. In the next transverse row 23 the dimples are arranged alternately with respect to the dimples at the same transverse location in row 22 so that tube 21B is engaged by the single dimple 23B the opposite face of the strip to dimples 23A and 23C. Thus, using the convention above, row 22 is UP-DOWN-UP and row 23 is DOWN-UP-DOWN.

In case of the triangular tube formation, the tubes on opposite sides of a tube lane are both supported by the tube stake, receiving their support from the tube-engaging zones extending out from both faces of the strip but, in this case, the support is given in a staggered, alternating manner which matches the staggered, alternating tube formation. Thus, the first pair of transverse rows (22, 23) supports tube 21B on side of tube lane L but one adjacent tube, 21A, on the opposite side of the tube lane receives support from this pair of rows; its support is also received from a row (not shown) of the next successive row pair. Similarly, tube 21D is supported by the tube-engaging zones in row pair 23, 24 but these two rows support two tubes, 21B and 21C on the opposite side of the tube lane.

Because the effective gap between the tubes (tube lane dimension) in the triangular tube formation is smaller than that of the rectangular formation, the plate thickness as well as the total depth of the dimples (peak to valley, including plate thickness) will typically be smaller than that for the rectangular arrangement. In the same way as described above, the tube stake may be inserted into the tube lane between the tubes and pushed into place until engagement with the tubes on both sides of the tube lane. Retention between the tube stake and the tubes is maintained by the elasticity of the metal and by the tube-engaging zones on the stake.

Figure 3:
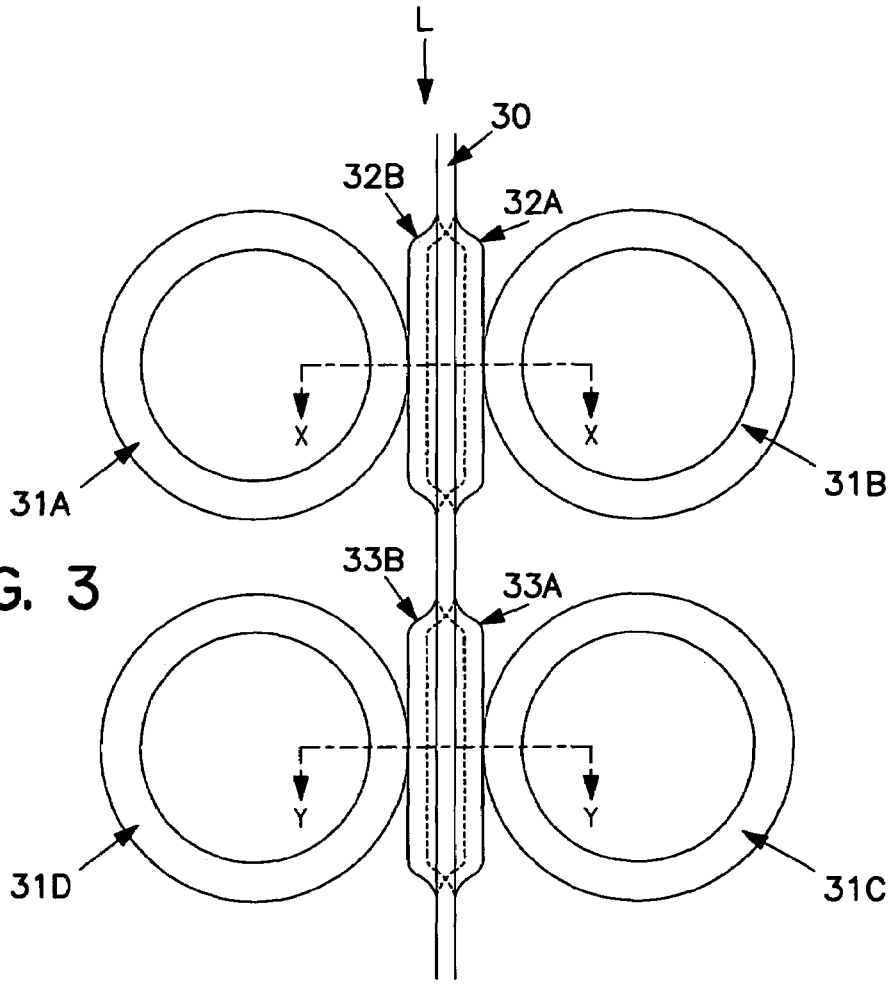
FIG. 3C shows the tube stake of FIG. 3 located in a different position with respect to the tubes in the tube bundle.
Figure 3A:
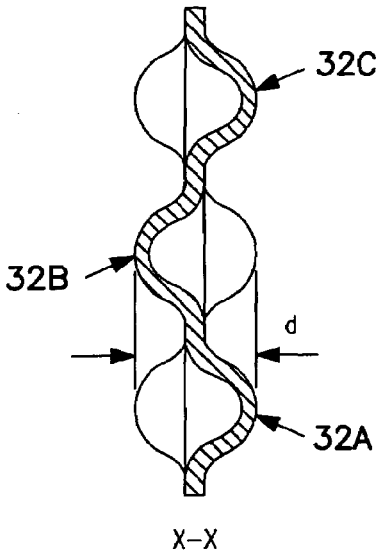
Figure 3B:
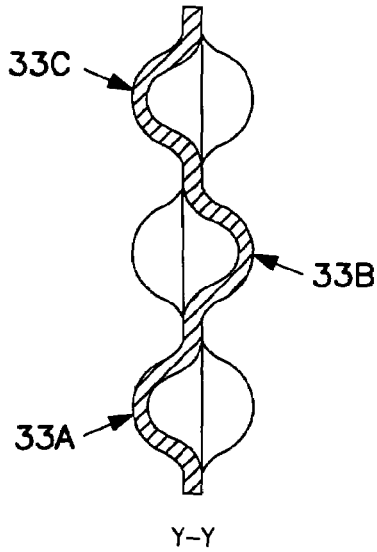

It is not essential for the tube-engaging areas to be in the form of dimples which engage a segment of each tube at two points. As shown in FIG. 3, the raised tube-engaging zones may be provided in the form of corrugations which extend longitudinally, parallel to the longitudinal axis of the tube stake to engage the tubes at one point around the circumference of the tubes. In FIG. 3, tube stake 30 is inserted into the tube lane L between tubes 31A and 31D on one side of the tube lane and tubes 31B and 31C on the other side of the lane. The rectangular tube formation is continued in the normal manner by other tubes in line with the four tubes shown. Tube stake 30 is provided with longitudinal corrugations arranged in successive transverse rows 32, 33 which continue along the length of the tube stake, spaced apart according to the spacing distance between the tubes in the bundle. The corrugations are arranged in a similar manner to the dimples described above, with corrugations in transverse rows forming the raised, tube-engaging zones, engagement taking place between adjacent tubes on opposite sides of the tube lane and each row of corrugations. Corrugations extend on both sides of the medial plane of tube stake 30, with corrugations 32A and 32C extending out to engage tube 31B and single corrugation 32C extending out on the other side of the medial plane of tube stake 30 to engage tube 31A. In the next transverse row of longitudinal corrugations, the corrugations are arranged alternately to those of row 32 (with respect to corrugations. at the same transverse location in the row), with corrugations 33A and 33C extending out on one side to engage tube 31D and single corrugation 33B extending out from the opposite face of the strip to engage tube 31C.

When the tube stake is inserted into the tube lane as shown in FIG. 3, there will be less positive locking engagement between the corrugations and the tubes than with the dimpled configurations of FIGS. 1 and 2 where the dimples engage with the tubes at two points around the circumference of the tubes to provide positive locking onto the surface of the tubes at two points of arc but the corrugated version has the advantage of being useful with a wider range of tube separations. By suitable choice of thickness in the metal of the tube stake and dimensioning of the raised, tube-engaging corrugations, frictional engagement between the tube stake and the tubes provides for retention of the tubes in place. The total depth (d) of the corrugations (peak to valley, including plate thickness), will normally be about 0.5 to 1.5 mm greater than the spacing between the tubes, i.e., the spacing between adjacent tubes on opposite sides of the tube lane into which the stake is inserted, in order to provide the desired support for the tubes and to retain the stake in place between the tubes. If, however, the stakes are to be inserted into each tube lane so that the tubes are supported on each side by a stake, the total depth, d, of the stake may be made equal to the tube lane dimension. In general terms, therefore, the total depth of the stake will be from 0 to 2 mm greater than the separation between the tubes.

Figure 3C:
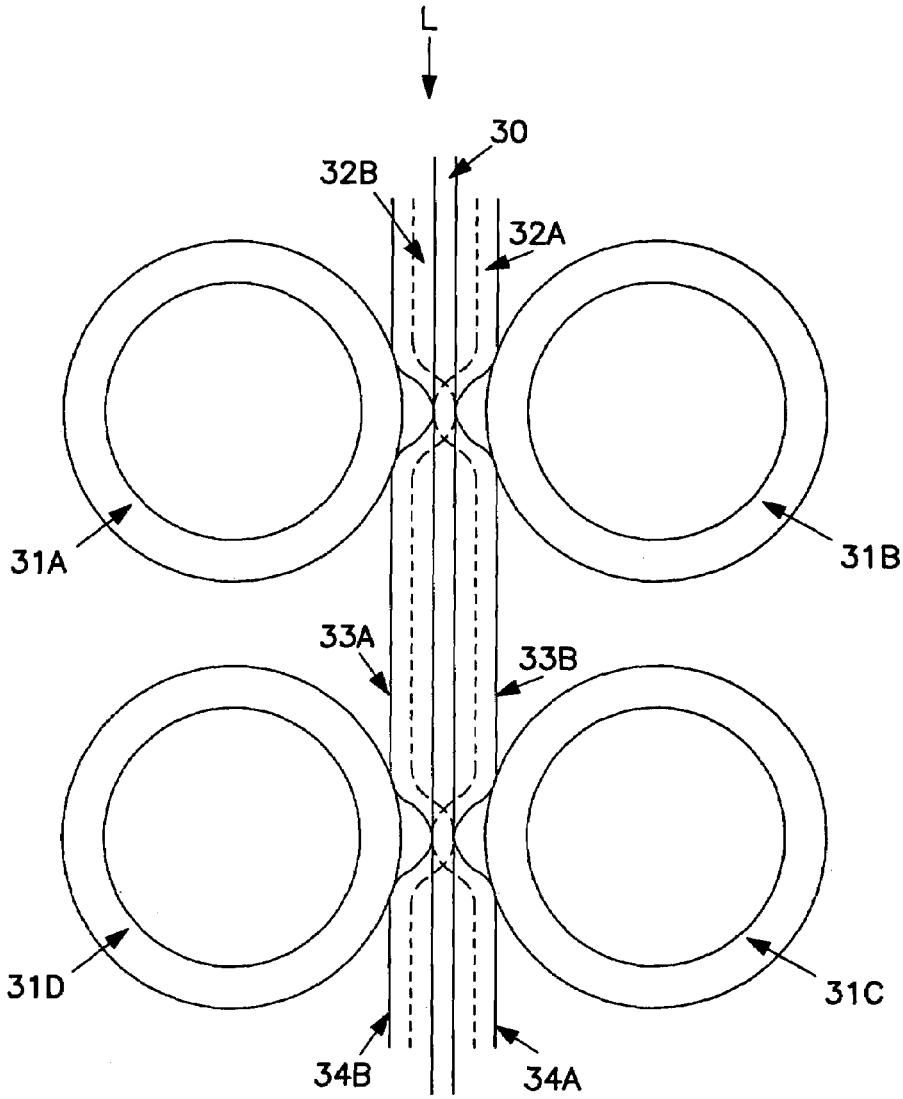

The corrugated tube stake may, however, be dimensioned, both in terms of corrugation length and total depth so that it may be inserted into the tube lane as shown in FIG. 3C, with each pair of successive transverse rows engaging with a pair of adjacent tubes on opposite sides of the tube lane., i.e. each corrugation engages two adjacent tubes on the same side of the tube lane with the tubes on each side of the lane nested between the corrugations in each pair of transverse rows. In FIG. 3C, tube stake 30 is inserted in tube lane L as in FIG. 3 but with corrugations 32A and 32C engaging on one side of tube 31B and corrugation 33B engaging on the other side of tube 31B, i.e. on a different portion of the arced surface of tube 31B facing into tube lane L. Corrugation 33B also engages with tube 31C on one portion of arc and the other portion of the arc facing tube lane L is engaged by the next succeeding corrugations along the length of the strip, 34A and another corrugation (not shown) extending out towards tube 31C similar to 34A, in a manner analogous to corrugations 32A and 32C. Similarly, on the opposite side of tube lane L, tube 31A is engaged on one portion of arc by corrugation 32C and on another portion of arc by corrugations 33A and 33C which also engage tube 31D which, in turn, is also engaged by corrugation 34B. In this way, the corrugations provide positive stake retention by engagement with the tubes at fixed locations along the length of the stakes. The total depth, d, of the corrugations when used in this way will be different (having regard to the size of the tubes) than when the corrugated form is used as shown in FIG. 3 because the corrugations extend beyond the margins of the tube lane defined by the closest approaches of the tube surfaces, that is, they extend into the inter-tube regions beyond the margins of the tube lane. As with the dimpled form shown in FIG. 1, the total depth of the stake in this case is desirably from 0.5 to 2 mm greater than the separation between the tubes. Appropriate selection of stake thickness and corrugation dimension relative to tube size will provide adequate positive location for the stakes in the tube bundle.

When the tube support stakes are inserted into the tube bundle, the raised tube-engaging zones have to be pushed past the tubes until the stake is in its proper place in the bundle. With the dimpled type of tube stake, each row of dimples has to be pushed through the gap between each pair of facing tubes until the stake is in place. Because the total depth of the tube engaging zones (peak-to-valley including plate thickness) is preferably greater than the inter-tube spacing, the tubes have to bend slightly to let the dimples pass; although this maintains the stake in place when it is in its final position, it makes insertion that much more difficult as the resistance to bending of each row of tubes has to be overcome. The variation in which raised corrugations are used is better in this respect, making insertion easier but at the expense of not having such multi-point retention once the stake is in place. The hybrid form of tube stake described below and shown in FIGS. 6 and 7 affords the easier insertion capability of the corrugated variant while retaining the good tube-retention capability of the dimpled form.

In the hybrid form of tube stake the raised tube-engaging zones are in the form of raised corrugations at the inner end of the stake (the end which is to be inserted into the center of the tube bundle) and in the form of dimples at the outer end of the stake (the end which is at the periphery of the tube bundle). As before, the tube-engaging zones are disposed in transverse rows across the strip at successive longitudinal locations along the length of the strip, extending laterally from both faces of the strip, away from the medial plane of the strip, to engage with tubes on opposite sides of the tube lane into which the stake is inserted. The corrugations on the inner end of the stake slide more readily between the tubes in the bundle, enabling the stake to be inserted more easily into the bundle while the dimples at the out end of the stake interlock with the tubes near the periphery of the bundle to provide good stake location and retention capabilities.

In this type of stake, the number of transverse rows of dimples at the outer end of the stake may be chosen more or less at wish, depending upon the relative importance attached to ease of stake insertion and positive stake retention. Typically, from three to ten rows of dimples in a normal length (about 20 to 50 cm) stake will be adequate to ensure good stake retention. The outer tube row may be supported on only one side by the outermost row of dimples depending on the configuration of the tubes at the periphery of the tube bundle but by providing a sufficient number of dimpled rows, adequate stake retention may be provided.

Figure 6:
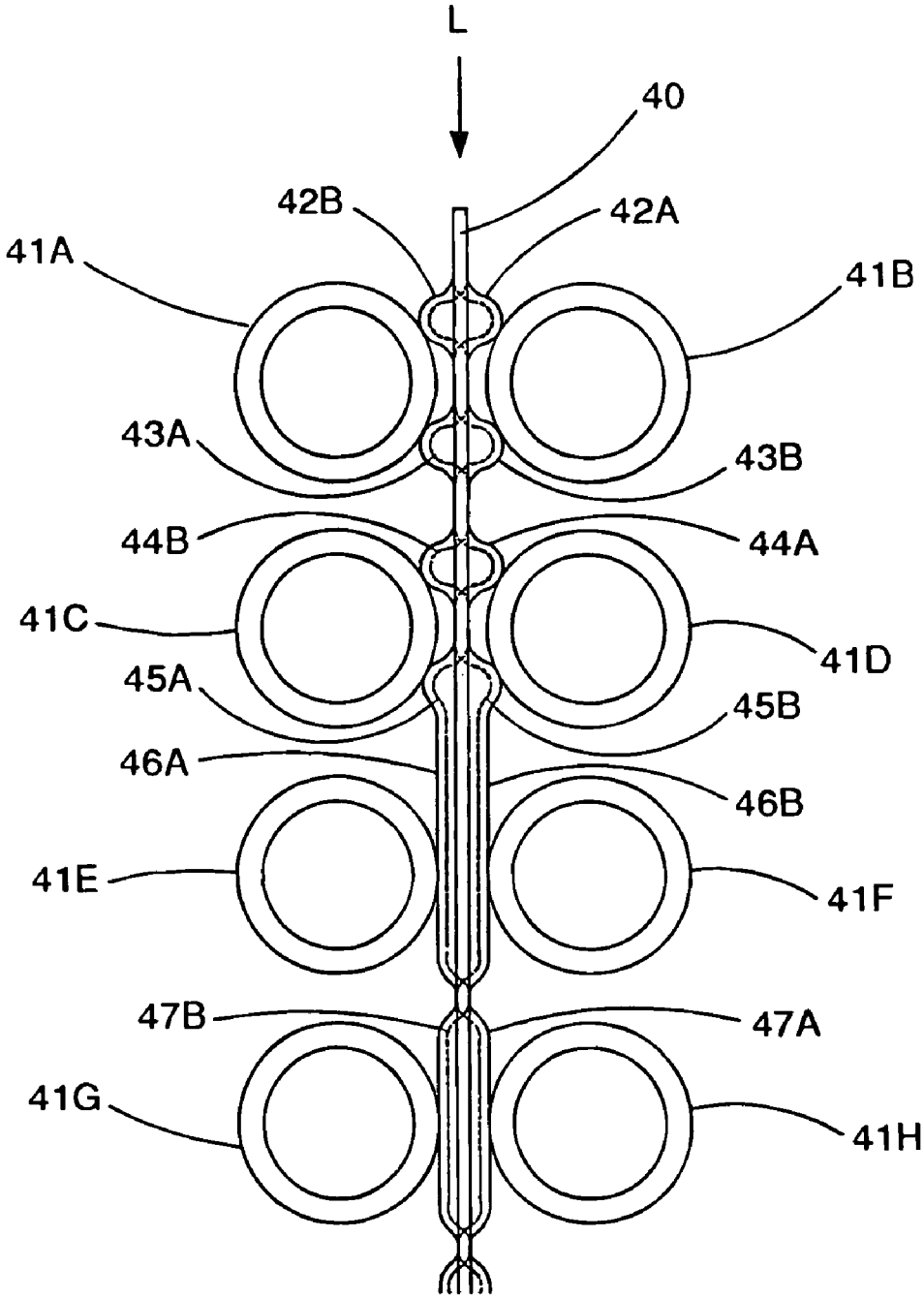
FIG. 6 is a cross-section of eight tubes in a rectangular arrangement heat exchanger with a tube stake with alternating raised tube-engaging zones on each side of the stake with dimples at the outer end of the stake and corrugations in its inner portion supporting the tubes.
Figure 7:
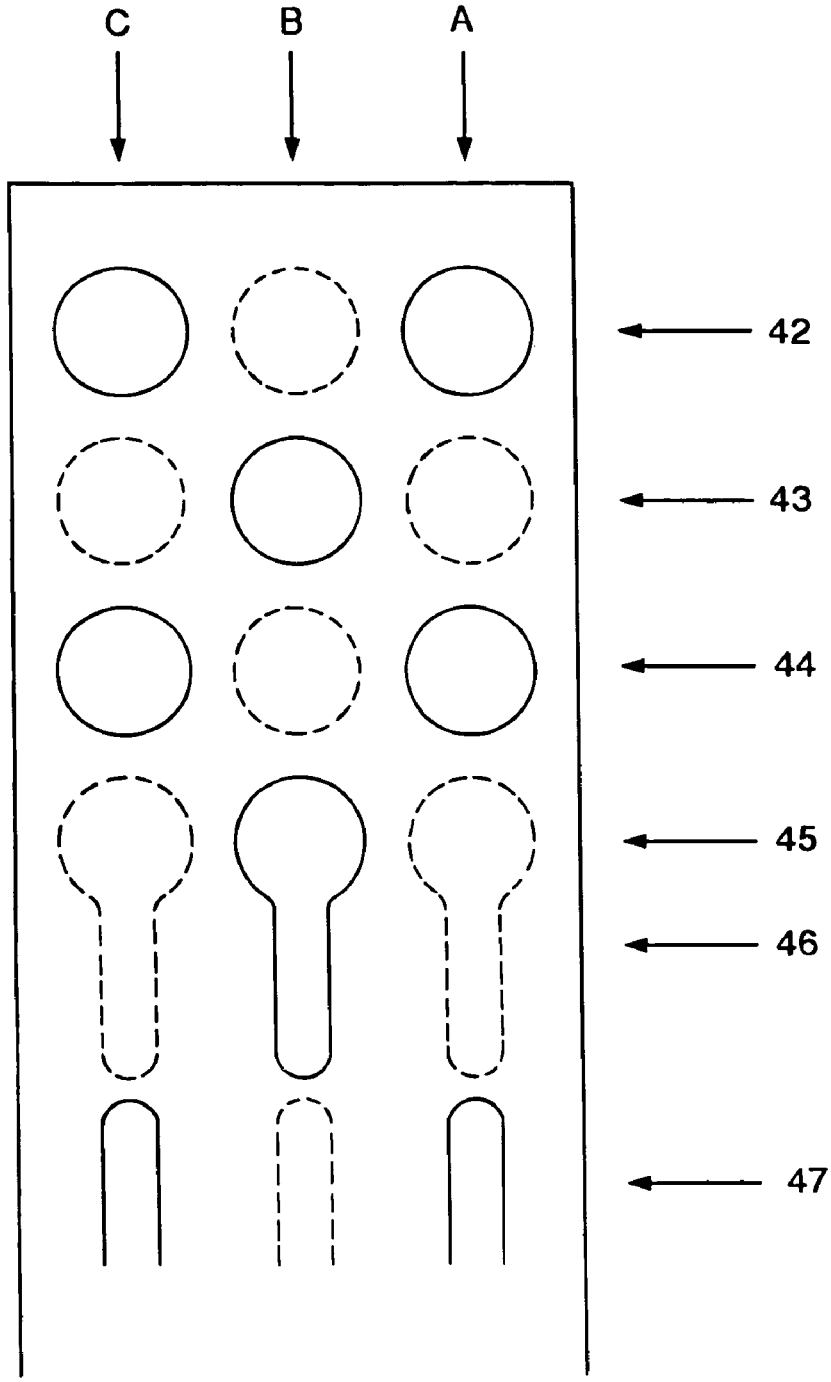
FIG. 7 shows a face view of the tube stake of FIG. 6.

FIG. 6 shows eight adjacent tubes in a tube bundle with a rectangular tube formation. A tube support device or tube stake 40 according to the present invention is inserted into the tube lane L between two rows of tubes. Tube stake 40 is formed from a strip of metal which extends in tube lane L defined by tubes 41A, 41C, 41E and 41G on one side of the lane and tubes 41B, 41D, 41F and 41H on the other side of the tube lane. In the complete tube bundle, there will be additional tubes extending in the row formed by a continuation of the tube rows, with other tube rows arranged in similar conventional manner making up the tube bundle. The tube lanes between these two adjacent rows and other adjacent rows of tubes will be similarly extensive across the tube bundle. Tube stake 40 has four transverse rows 42, 43, 44, 45 of raised tube-engaging zones in the form of raised, generally circular dimples extending across the strip, with row 45 merging into the first row of corrugations 46 so that the merged dimples/corrugations form a keyhole-shaped tube-engaging zone which has a quasi-circular dimple 45A, 45B, 45C at the end of the stake and a linear corrugation 46A, 46B, 46C at the inner end. FIG. 7 shows the arrangement of the dimples in longitudinal lines designated A, B and C and in transverse rows designated 42, 43 and 44 so that the dimples may be designated by row and line as 42A, 42B, 42C and so on in each of rows 42, 43 and 44 and the corrugations 46A, 46B, 46C and so on in each of rows 46, 47 and successively further along the length of the stake.

Like the dimples in rows 42 to 45, the corrugations in rows 47 and onwards extend out from each face of the strip in an alternating arrangement across each transverse row and along each axial line A, B, C. In FIG. 7, the same convention is used for indicating the side on which the corrugation is formed: full lines indicate a corrugation extending in one direction, dashed lines in the opposite direction from the face of the strip. As described above, the corrugations of row 46 are formed as continuations of dimples 45A, 45B and 45C, extending out on the same side of the strip, so that each of the dimples in row 45 and its corresponding corrugation 46 forms a continuous raised, tube-engaging zone shaped like an old-fashioned keyhole. Although this is not required for the purposes of providing support for the tubes, it does reduce the forming stresses on the strip.

The transverse rows are arranged at successive longitudinal locations along the length (longitudinal axis) of the strip: each pair of successive rows is positioned to provide support for a pair of tubes which are adjacent one another on one side of tube lane L, with each row (except the outermost row) providing support for a pair of tubes which are adjacent one another but on opposite side of the tube lane. Thus, rows 42 and 43 provide support for tube 41A on one side of tube lane L and tube 41B on the other side of the lane. Similarly, rows 44 and 45 provide support for tubes 41C and 41D on opposite sides of the tube lane by means of the dimples extending out on each side of the strip.

The dimples in row 42 are formed as shown in FIG. 7: dimples which extend laterally from the strip towards the tubes on one side of the strip (41B, 41D, 41F, 41H) are designated by complete circles (e.g. 42A, 42C), the dimples which extend towards the tubes on the opposite side of the tube lane (41A, 41C, 41E, 41G) are shown by dashed circles (e.g. 42B, 43A, 43C). In FIG. 7, this is illustrated by the same convention used with FIG. 4, with full lines indicating a dimple raised in one direction from the strip and by dashed circles indicating a dimple raised in the other direction. Thus, the dimples which lie in a single axial line (along the length of the strip, designated as the lines A, B and C in FIG. 2) alternate first in one direction from the face of the strip and then the other. In this way, support is provided in a regular, repeating manner for the tubes.

As with the configurations shown in FIGS. 3 and 3C, the lengths of the corrugations (longitudinally) can be set so that either (as in FIG. 3), each row of corrugations engages with a pair of adjacent tubes on opposite sides of a tube lane or in a nesting arrangement (as in FIG. 3C) with a pair of adjacent tubes on the same side of the lane.

The arrangement shown in FIG. 7 with three raised tube-engaging zones in each transverse row is convenient and typical for a tube stake with a width of approximately 4–6 cm, convenient for many applications. However, the width of the stake could be larger, for example, up to about 20 cm and in this case a larger number of raised tube-engaging areas could be provided in each transverse row, for example, 5 raised dimples arranged 3 and 2 on alternate sides of the strip. It is not essential to use an odd number of raised zones although this provides a symmetrical degree of support with three, the minimum number of tube-engaging zones. Other arrangements might, however, be used, depending on the number of raised, tube-engaging zones in each transverse row. For example, using a convention to designate rows 42 and 43 as:

| | |
|---|---|
| Row 42: | UP - DOWN - UP |
| Row 43: | DOWN - UP - DOWN, |

a pair of rows in a wider strip with four raised tube-engaging zones might suitably have the following arrangement:

| | |
|---|---|
| Row 1: | UP - DOWN - UP - DOWN |
| Row 2: | DOWN - UP - DOWN - UP |

The use of the larger number of tube-engaging zones on this wider strip permits, however, a deviation from the alternating arrangement of tube-engaging zones while still retaining a symmetrical disposition, for example:

| | |
|---|---|
| Row 1: | UP - DOWN - DOWN - UP |
| Row 2: | DOWN - UP - UP - DOWN |

Note: as before, the designations "UP" and "DOWN" do not refer to true vertical directions but only to the relative directions from the medial plane and faces of the strip.

The placings of the transverse rows of raised, tube-engaging zones on the tube stake are to provide the desired engagement between the tube stake and the tubes in the tube bundle with which they are being used. To accommodate pass lanes in the tube bundles, the distances between successive transverse rows of raised, tube-engaging zones (dimples, corrugations) may be increased correspondingly, consistent with the arrangement of tubes in the bundle.

As can be seen from the drawings, each tube stake engages with tubes on opposite sides of a tube lane so that insertion of a stake in each tube lane provides support for two rows of tubes within the outer periphery of the tube bundle. At the periphery of the bundle some tubes may receive support from a stake which does not support a tube on the other side. This reduces the effective support given to those tubes but since the length of stake extending out from the last pair of tubes within the bundle is relatively short, some effective support is given to these outer tubes on one side at least by the cantilevered end of the stake.

While the frictional engagement between the stakes and the tubes will provide for retention of the stakes in the bundle, the end of the tube stake may be provided with a tube-engaging crook, to hook over the end of a tube on one side of the tube lane to prevent withdrawal of the stake in one direction. Alternatively, the stakes may be folded into a U-shaped or hairpin configuration which has, effectively, a pair of the stakes conjoined at one end by means of an arcuate, tube-engaging segment. This configuration provides stiffening for three tube rows simultaneously with additional positive location for the stake from the closed end of the hairpin (the arcuate segment) being locked over of the peripheral tubes at one end to the bundle. Because each stake provides stiffening for three tube rows simultaneously, the U-shaped tube stakes will be inserted over alternate rows to provide stiffening for each row of tubes in the tube bundle. If desired, additional stake retention may be provided by retention members such as bolts extending between the arms of the hairpin at one or more points along its length. Additional locking for single-line stakes (not formed into the U-configuration) may be provided by punching out a small hole in the end of the stake through which a metal band can be passed. This metal band would be secured, for example, to tie rods that are available in the tube bundle device adjacent to the outer tube circumference of the tube bundle, to reduce the possibility of tube supports sliding down the tubes.

The tube stakes are suitably made of a metal which will resist corrosion in the environment of the tube bundle device in which it is to be used. Normally, to resist corrosion in both water and other environments, stainless steel will be satisfactory. Stainless SS 304 is suitable except when chloride corrosion is to be expected when duplex stainless steel will be preferred. The duplex stainless steels which contain various amounts of the alloying elements chromium, nickel and optionally molybdenum are characterized by a mixed microstructure with about equal proportions of ferrite and austenite (hence the common designator "Duplex"). The chemical composition based on high contents of chromium, nickel and molybdenum provides a high level of intergranular and pitting corrosion resistance. Additions of nitrogen promote structural hardening by interstitial solid solution mechanism, which raises the yield strength and ultimate strength values without impairing toughness. Moreover, the two-phase microstructure guarantees higher resistance to pitting and stress corrosion cracking in comparison with conventional stainless steels. They are also notable for high thermal conductivity low coefficient of thermal expansion, good sulfide stress corrosion resistance and higher heat conductivity than austenitic steels as well as good workability and weldability. The duplex stainless steels are a family of grades, which range in corrosion performance depending on their alloy content. Normally, duplex grades such as 2304, 2205 will be adequate for heat exchanger service with the final selection to be made consistent with recognized corrosion resistance requirements.

Insertion of the tube stakes into the tube bundle is facilitated by first inserting a metal bar with beveled edges having a thickness that is slightly greater than the total depth of the stake (including the dimples or other raised zones) after which the stake is inserted into place and the metal bar is slowly removed to ensure the proper locking in of the tubes and the tube stake. The bar may also be used in a similar manner to facilitate removal of the stakes. The stakes may be inserted at axial locations determined by experience or by vibration studies for the relevant equipment. The stakes may be inserted into the bundle in different transverse directions at different axial locations, for example in a vertical direction at the first axial location, in the horizontal at the second location, followed in alternate sequential manner at successive axial locations along the length of the tube bundle.

Besides its good stake retention capability, another major advantage of the present type of stake is its simplicity. Unlike the stakes shown in U.S. Pat. Nos. 4,919,199 and 5,213,155 which require the metal strip to be formed by pressing in two directions, longitudinally into the U- or V-shaped channel and transversely to form the tube-receiving saddles, an expensive operation involving large machines in which the press force could be as large as 10 tonnes. The tube-engaging zones of the present stakes, by contrast, can be formed by a single pressing operation in the transverse direction, fabricating several rows of dimples or corrugations at a time, with successive pressings along the length of the stake, in a simple press with a low pressing force. The use of two press rolls would, of course, represent be the most economical option for large scale manufacture but is not necessary and the cheaper, simpler equipment could be used failing access to greater resources.

The invention claimed is:

1. A tube support device for a tube bundle having tubes arranged in rows with tube lanes separating the tube rows, the tube support device comprising:

an elongated longitudinally extending strip having a pair of opposing faces and a plurality of successive transverse tube support rows located at successive longitudinal locations along the strip, wherein each tube support row having a plurality of raised, tube-engaging zones, wherein at least two of the plurality of raised, tube-engaging zones extend laterally outwards from one of the pair of opposing faces and at least one of the plurality of raised, tube-engaging zones extends laterally outwards from another one of the pair of opposing faces, wherein the plurality of raised, tube-engaging zones extend laterally outwards to engage with tubes in the tube bundle on opposite sides of a tube lane, wherein at least one tube in the tube bundle is engaged by at least one raised tube engaging zone of each of at least two tube support rows of the tube support device.

2. A tube support device according to claim 1 in which the tube-engaging zones in each transverse row alternately extend outwardly from one face of the strip and the other.

3. A tube support device according to claim 1 in which the tube engaging zones at corresponding transverse locations in adjacent transverse rows extend outwards from opposite faces of the strip.

4. A tube support device according to claim 3 in which each transverse row includes an odd number of raised, tube-engaging zones, with the raised, tube-engaging zones in each row extending successively from opposite faces of the strip.

5. A tube support device according to claim 1 in which the raised, tube-engaging zones comprise raised dimples which extend outwards from their respective face of the strip.

6. A tube support device according to claim 1 in which the raised, tube-engaging zones comprise longitudinally extensive corrugations which extend outwards from their respective face of the strip.

7. A tube support device for a tube bundle having tubes arranged in rows with tube lanes separating the tube rows, the tube support device comprising:

a longitudinally extensive strip having a plurality of successive transverse rows located at successive longitudinal locations along the strip;

wherein each row having a plurality of raised, tube-engaging zones on each face of the strip, extending laterally outwards from both faces of the strip to engage with tubes in the tube bundle on opposite sides of a tube lane, wherein at least one transverse rows at one end of the strip comprises raised dimples and, wherein at least one transverse row at the other end of the strip comprises longitudinally extensive corrugations.

8. A tube support device according to claim 7, wherein the strip comprising a plurality of transverse rows of raised dimples and a plurality of longitudinally extensive corrugations.

9. A tube support device according to claim 7 in which the total depth of the raised dimples from one side of the strip to the other is greater than the total depth of the corrugations from one side of the strip to the other.

10. A tube bundle device comprising:

a plurality of tubes arranged in rows with tube lanes separating the tube rows;

at least one tube support device, wherein the plurality of the tubes being supported by the at least one tube support device located in the tube lanes, wherein each tube support device comprising;

an elongated longitudinally extending strip having a pair of opposing faces and a plurality of successive transverse tube support rows of a plurality of raised, tube-engaging zones located at successive longitudinal locations along the strip, wherein at least two of the plurality of raised, tube-engaging zones extend laterally outwards from one of the pair of opposing faces and at least one of the plurality of raised, tube-engaging zones extends laterally outwards from another one of the pair of opposing faces, wherein the plurality of raised, tube-engaging zones extend laterally outwards to engage with tubes in the tube bundle on opposite sides of a tube lane in the tube bundle, wherein at least one tube in the tube bundle is engaged by at least one raised tube engaging zone of each of at least two tube support rows of the tube support device.

11. A tube bundle device according to claim 10 in which the tube-engaging zones in each transverse row of the tube support devices alternately extend outwardly from one face of the strip and the other.

12. A tube bundle device according to claim 10 in which the tube engaging zones at corresponding transverse locations in adjacent transverse rows of the tube support devices extend outwards from opposite faces of the strip.

13. A tube bundle device according to claim 10 in which the raised, tube-engaging zones of the tube support devices comprise raised dimples or longitudinally extensive corrugations which extend outwards from their respective face of the strip.

14. A tube bundle device according to claim 10 in which the tube engaging zones at the outer ends of the tube support devices at the periphery of the tube bundles comprise raised dimples and the tube-engaging zones away from the periphery of the tube bundle comprising longitudinally extensive corrugations.

15. A tube bundle device according to claim 14 in which the total depth of the raised dimples from one side of the strip to the other is greater than the total depth of the corrugations from one side of the strip to the other.

16. A tube bundle device according to claim 10 in which the tubes in the tube bundle are arranged in rectangular formation with orthogonal rows of tubes and tube lanes, and in which the tubes are supported by tube support devices located in tube lanes, each tube support device comprising a longitudinally extensive strip having a plurality of pairs of successive transverse rows of raised tube-engaging zones, the pairs of rows being located at successive longitudinal locations along the strip, each transverse row having a plurality of raised, tube-engaging zones on each face of the strip extending laterally outwards from both faces of the strip to engage with a pair of adjacent tubes on opposite sides of the tube lane with each pair of adjacent transverse rows of raised, tube-engaging zones engaging with a pair of adjacent tubes on opposite sides of the tube lane.

17. A tube bundle device according to claim 10 in which the tubes in the tube bundle are arranged in rectangular formation with orthogonal rows of tubes and tube lanes, and in which the tubes are supported by tube support devices located in tube lanes, each tube support device comprising a longitudinally extensive strip having a plurality of successive transverse rows of raised longitudinally-extensive corrugated tube-engaging zones, the rows being located at successive longitudinal locations along the strip, each transverse row having a plurality of the raised, longitudinally-extensive corrugated tube-engaging zones on each face of the strip extending laterally outwards from both faces of the strip to engage with a pair of adjacent tubes on opposite sides of the tube lane.

18. A tube bundle device according to claim 10 in which the tubes in the tube bundle are arranged in rectangular formation with orthogonal rows of tubes and tube lanes, and in which the tubes are supported by tube support devices located in tube lanes, each tube support device comprising a longitudinally extensive strip having a plurality of successive transverse rows of raised longitudinally-extensive corrugated tube-engaging zones, the rows being located at successive longitudinal locations along the strip, each transverse row having a plurality of the raised, longitudinally-extensive corrugated tube-engaging zones on each face of the strip extending laterally outwards from both faces of the strip to engage with a pair of adjacent tubes on opposite sides of the tube lane, with each pair of transverse, adjacent rows of tube-engaging zones engaging with a pair of adjacent tubes on opposite sides of the tube lane.

19. A tube bundle device according to claim 10 in which the tubes in the tube bundle are arranged in rectangular formation with orthogonal rows of tubes and tube lanes and in which the tubes are supported by tube support devices located in tube lanes, each tube support device comprising a longitudinally extensive strip having a plurality of successive transverse rows of raised dimples at the outer ends of the tube support devices at the periphery of the tube bundles and longitudinally-extensive corrugated tube-engaging zones away from the periphery of the tube bundle, the rows being located at successive longitudinal locations along the strip, each successive pair of transverse rows of dimples engaging with a pair of adjacent tubes on opposite sides of the tube lane in which the support device is located and each successive transverse row of longitudinal corrugations engaging wit a pair of adjacent tubes on opposite sides of the tube lane.

20. A tube bundle device according to claim 10 in which the tubes in the tube bundle are arranged in triangular formation with rows of tubes in staggered, alternating-row arrangement and tube lanes between the tube rows, in which the tubes are supported by tube support devices located in the tube lanes, each tube support device comprising a longitudinally extensive strip having a plurality of successive transverse rows of raised tube-engaging zones, the transverse rows being located at successive longitudinal locations along the strip, each transverse row having a plurality of raised, tube-engaging zones on each face of the strip extending laterally outwards from both faces of the strip to engage with a pair of adjacent tubes in adjacent tube rows on opposite sides of the tube lane.

21. A tube support device according to claim 8, wherein one row of raised dimples is positioned next to a row of raised corrugations such that each dimple merges into the end of a corrugation in the same longitudinal line along the lengthwise axis of the strip.

22. A tube support device according to claim 1, wherein the tubes on opposite sides of the tube lane deflect a predetermined amount when the tube support device is inserted in the tube lane.

23. A tube bundle device according to claim 10, wherein the tubes on opposite sides of the tube lane deflect a predetermined amount when the tube support device is inserted in the tube lane.

* * * * *